US006412332B1

(12) United States Patent
Bartonek

(10) Patent No.: US 6,412,332 B1
(45) Date of Patent: Jul. 2, 2002

(54) METHOD AND APPARATUS FOR DETECTING OBJECTS DRAGGING BENEATH A TRAIN

(75) Inventor: Mark J. Bartonek, Blue Springs, MO (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/386,202

(22) Filed: Aug. 31, 1999

(51) Int. Cl.[7] ..... G01M 7/00

(52) U.S. Cl. ..... 73/12.01; 73/12.09

(58) Field of Search ..... 73/11.01, 12.01, 73/12.04, 12.05, 12.09, 12.11

(56) References Cited

U.S. PATENT DOCUMENTS 5,551,280 A * 9/1996 Lee ..... 73/12.09

* cited by examiner

*Primary Examiner*—Benjamin R. Fuller
*Assistant Examiner*—Maurice Stevens
(74) *Attorney, Agent, or Firm*—Carl A. Rowold; B. Trent Webb

(57) ABSTRACT

A dragger detects objects dragging beneath a train as the train travels along a track. The dragger includes at least one stationary impact element and a detection circuit including at least one sensor coupled with impact element for sensing the force of the impacts between the objects and the impact element. A method for detecting objects dragging beneath a train involves positioning the stationary impact element along the track in a fixed position intersecting the path of movement of the objects. The method also involves sensing the force of each impact and generating an output signal if the magnitude of any impact is greater than a predetermined magnitude.

31 Claims, 5 Drawing Sheets

METHOD AND APPARATUS FOR DETECTING OBJECTS DRAGGING BENEATH A TRAIN

BACKGROUND OF THE INVENTION

This invention relates in general to a method and apparatus for detecting objects dragging beneath a train as the train travels along a track and, more particularly, to a method and apparatus for detecting objects dragging beneath a train by sensing the force of impact between the object and a stationary impact element which is positioned along the track in the path of movement of the object.

The present invention addresses a long-standing problem in the railroad industry. A variety of objects are typically secured at or near the underside of a train and from time to time some of those objects will become loose or partially detached from the train. For example, the vibration of the train traveling along the track may cause an air hose, a pipe or another object to drag beneath the train. Dragging objects present a potential safety problem which could result in derailment. Moreover, dragging objects may damage switches, tracks, ties and crossings.

To reduce the risk of derailment and other potential damage caused by dragging objects, "draggers" have been used to detect the presence of objects dragging beneath a moving train. As an example, draggers may be placed at 20 mile intervals over long stretches of a railroad track, with additional draggers positioned near road crossings. If a dragging object is detected, the train is stopped so that the object can be secured to reduce the potential for derailment or other problems. The height of the dragger is determined by balancing the risk of not detecting an object (such as an air hose) which is not dragging very far below the bottom of the train against the likelihood of unnecessarily stopping the train numerous times. Draggers are usually set at a height of about one inch below the top rail so that only objects hanging well below the train will be detected. Air hose detectors, on the other hand, typically extend a couple of inches above the top rail. Consequently, air hose detectors are primarily used in railroad yards rather than open stretches of track so that fast-moving trains will not have to make frequent stops to secure low-risk objects.

One conventional dragger rotates on a shaft between a non-impact position and an impact position. A mechanical contact detects an impact when the dragger is forced into its impact position. For example, a contact which is normally open when the dragger is in its non-impact position closes when the dragger moves to its impact position. These draggers are typically biased to return to the non-impact position to avoid the need to manually reset the dragger.

The conventional dragger described above has several drawbacks. Because it relies upon moving parts, it requires considerable maintenance (e.g., lubrication). If the dragger becomes stuck in the impact position, it must be manually reset or it will remain in a constant alarm mode. In colder climates, snow or ice may accumulate on the tracks and inhibit operation of the dragger. To prevent snow and ice build-up, electric pan heaters have been installed around these draggers with limited success. The installation and use of pan heaters is costly and softens the roadbed between ties, which may result in an uneven path for the train. It is also difficult to set and to adjust the minimum force needed to trigger an alarm.

Another conventional approach is to place a brittle metal bar or a wire across the track so that it will break upon impact. This one-shot approach is flawed in that it results in a loss of protection from the time the bar or wire is broken until it is later replaced. A similar approach involves a portable dragger with a metal bar which is often sent flying in an unpredictable direction upon impact. The flight of this metal bar is dangerous to people on the ground and could cause derailment if it lands on the rail. The metal bar sometimes becomes dislodged in response to vibrations from the train, which causes the portable dragger to falsely report alarms. As those skilled in the art will appreciate, trains with "flat wheels" are particularly likely to trigger a false alarm as they travel toward a portable dragger.

Yet another conventional dragger uses audible sensors to detect the presence of an object dragging from a train by sensing the sound or tone which results from the impact between the object and the dragger. This type of dragger is difficult to install and does not perform well in extreme weather conditions. It must be adjusted frequently because the sensitivity of the sensors varies dramatically with temperature changes, and adjustment is difficult due to the indirect means of sensing an impact based on the sound it makes. Moreover, snow and ice dampen the sound from an impact and thus adversely affect the ability of the audible sensors to accurately detect the occurrence of an impact. Consequently, these draggers may not work in snowy and icy conditions without a pan heater.

Another common problem with conventional draggers is that the associated circuitry does not automatically detect faults (e.g., open circuits, short circuits and power failures) in the dragger cable. For example, if a normally closed dragger cable shorts or a normally open dragger cable opens, a fault exists which will prevent the dragger from detecting a dragging object.

SUMMARY OF THE INVENTION

Among the several objects and advantages of the present invention may be noted the provision of an improved apparatus and method for detecting objects dragging beneath a train as the train travels along a track; to provide such an apparatus and method which reduces or eliminates false alarms caused by flat wheels; to provide such an apparatus which requires less maintenance than draggers which rely on moving parts; to provide such an apparatus which is more durable than conventional draggers; to provide such an apparatus which performs effectively in snowy and icy conditions without a heater; to provide such an apparatus and method which monitors each sensor cable for faults; to provide such an apparatus with improved troubleshooting capabilities to provide such an apparatus which can be conveniently and economically installed and adjusted; to provide such an apparatus having an impact element which is reversible and interchangeable with other such impact elements; to provide such an apparatus which can conveniently replace conventional draggers having moving parts. These and other related objects of the present invention will become readily apparent upon further review of the specification and drawings.

Briefly, the present invention is directed to an apparatus for detecting objects dragging beneath a train as the train travels along a track. The apparatus of the present invention includes a first stationary impact element adapted to be rigidly supported along the track in a position intersecting the path of movement of the objects to be detected as they are dragged beneath the train so that the objects impact the first impact element. The apparatus also includes a detection circuit having a first sensor coupled with the first impact element for sensing the force of the impacts between the objects and the first impact element.

In another aspect, the present invention is directed to a method of detecting objects dragging beneath a train as the train travels along a track. The method of the present invention includes the step of positioning a stationary impact element along the track in a fixed position intersecting the path of movement of the objects to be detected as they are dragged beneath the train so that the objects impact the stationary element. The method further includes the steps of sensing the force of each impact and generating an output signal if the magnitude of any impact is greater than a predetermined magnitude.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE DRAWINGS

Figure 1:
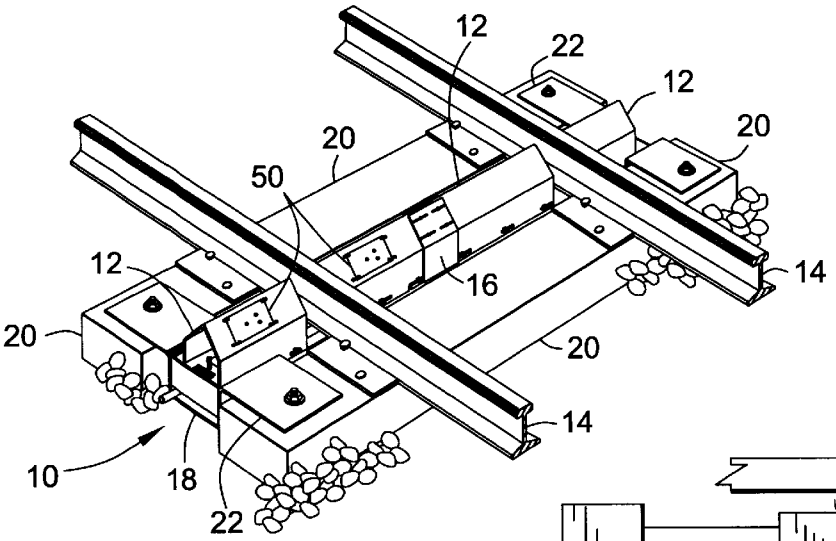
FIG. 1 is a fragmentary perspective view of a preferred embodiment of the static dragger apparatus of the present invention installed along a railroad track.
Figure 2:
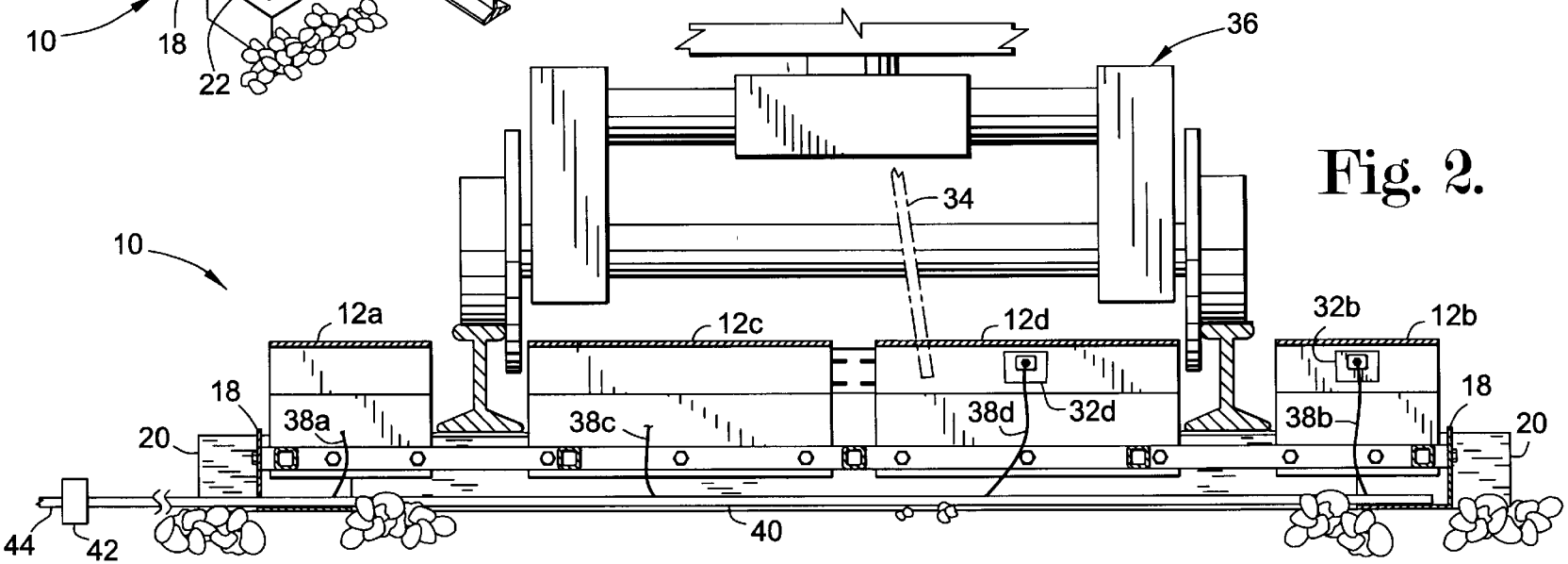
FIG. 2 is an enlarged sectional view of the dragger apparatus of FIG. 1 with a train being shown on the track and with phantom lines representing an object dragging beneath the train.

Referring to the drawings in greater detail, and initially to FIGS. 1 and 2, the apparatus of the present invention is designated generally by reference numeral 10. The dragger apparatus 10 comprises one or more stationary impact elements 12. The disclosed embodiment includes two impact elements 12*a*, 12*b* which are located outside of a track 14, and two impact elements 12*c*, 12*d* which are located inside the track 14 and rigidly coupled together with a connector plate 16. The connector plate covers the gap between elements 12*c*, 12*d*.

The impact elements 12*a*–12*d* are mounted in a frame 18 disposed below the track 14 and between a pair of wood ties 20. Alternatively, the impact elements could be attached to the ties. The impact panels 12 are fastened to the frame 18 with flange nuts, and the frame is fastened to the ties 20 with a pair of U-tie brackets 22. For concrete ties, a concrete tie clamp assembly is used in addition to the U-tie brackets.

It may be necessary to prepare the track 14 prior to installation of the dragger apparatus 10. Preferably, the dragger 10 is installed between two ties 20 which are parallel to one another and perpendicular to the track 14. If tie spacing or location is not acceptable, it may be necessary to make adjustments using a track jack. The ballast between the ties 20 should be removed until it is flush with the bottom of the ties, and the ballast should be cleaned from under the ends of the ties to allow for mounting of the U-tie brackets.

The static dragger 10 further comprises a detection circuit 30 (FIG. 3) including at least one sensor 32. As shown in FIGS. 1 and 2, each element 12 houses an impact sensor 32 for sensing the force of the impact between an object 34 dragging below a train 36. The sensors 32 are preferably piezoelectric accelerometers such as the commercially available Model A5001-01 (for applications up to 5,000 g's) and Model A5010-01 (for applications up to 500 g's) both marketed by Ocean Sensor Technologies, Inc. of Virginia Beach, Va.

The detection circuit 30 also includes a dragger cable 38 corresponding to each sensor 32. One end of each cable 38 is attached to the sensor 32 with lock ring connectors, and the other end of each cable extends through a first conduit 40 which terminates at a junction box 42. The conduit 40 is preferably fastened to the bottom of the frame 18. The junction box 42 can be a stand-alone alone unit (as shown schematically in FIG. 2), or it can be attached to one end of the dragger 10. Then, the cables 38 extend through a second conduit 44 to an interface board 46 (FIG. 3) which is typically mounted on a wall or rack inside an equipment building located in the right-of-way. Alternatively, the sensors 32 can be connected to the interface board 46 without a junction box.

In the preferred embodiment, each sensor 32 is carried by a removable sensor mount plate 50. The plate 50 is dimensioned or keyed so that the sensor 32 can only be disposed within the impact element 12 in a predetermined orientation. As shown in FIG. 1, the plate 50 is angled with respect to the sensor 32 and disposed within the impact panel 12 such that the plate 50 is flush with the outer surface of the panel 12 and the sensor 32 is disposed in a horizontal orientation. In this way, the single axis sensor 32 detects the horizontal component, and not the vertical component, of any impact forces imparted on the panel 12 by objects dragging beneath the train. The exclusion of vertical forces avoids the problem in the prior art of triggering false alarms by detecting vibrations from flat wheels. With the sensor 32 properly positioned inside the panel 12, impact forces are thus transferred from the panel 12 to the plate 50 and to the sensor 32. The sensors 32*a*–32*d* are interchangeable with one another, and the plates 50 are interchangeable with one another.

Figure 3:
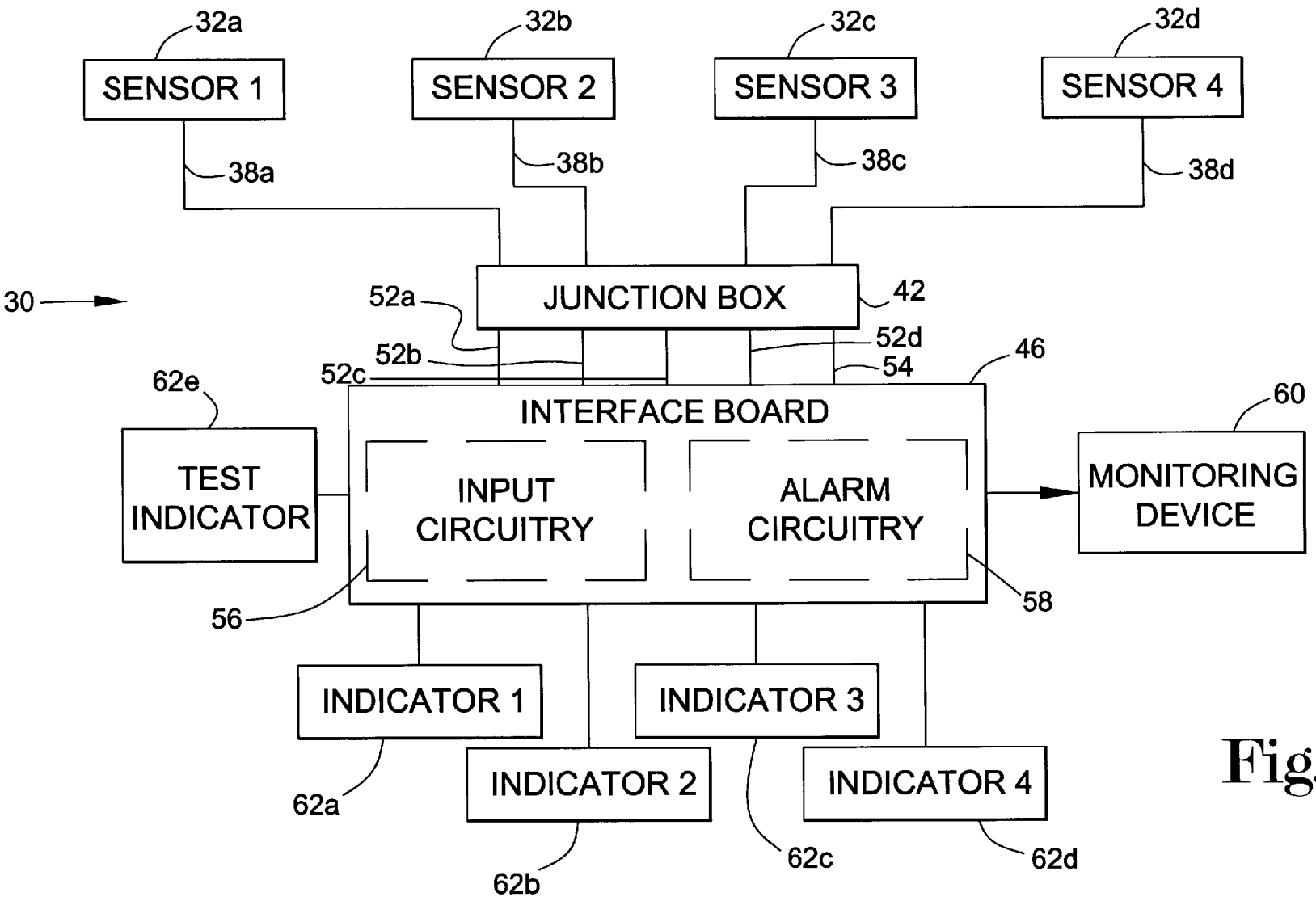
FIG. 3 is a block diagram of a preferred embodiment of the detection circuit of the present invention coupled to a monitoring device.

FIG. 3 is a block diagram illustrating a preferred arrangement for detection circuit 30. Dragger cables 38*a*–38*d* extend respectively from the sensors 32*a*–32*d* to the junction box 42. Each cable 38 is a two-conductor cable, having one hot wire and one common wire. Each of the hot wires 52*a*–52*d* extends beyond the junction box 42 to the interface board 46. The four common wires are combined at the junction box 42 so that a single common wire 54 extends to the interface board 46. The interface board includes both input circuitry 56 (FIGS. 4*a*–4*b*) and alarm circuitry 58 (FIGS. 5*a* and 5*b*), and the output of the board 46 is transmitted to a monitoring device 60. The monitoring device is a conventional device which communicates an alarm condition to the train crew. The printed circuit board 46 also includes a number of indicators 62*a*–62*d* corresponding to the sensors 32*a*–32*d*. A test indicator 62*e* is provided for testing and troubleshooting purposes. The indicators 62*a*–62*e* are preferably light emitting diodes (LEDs).

Figure 4A:
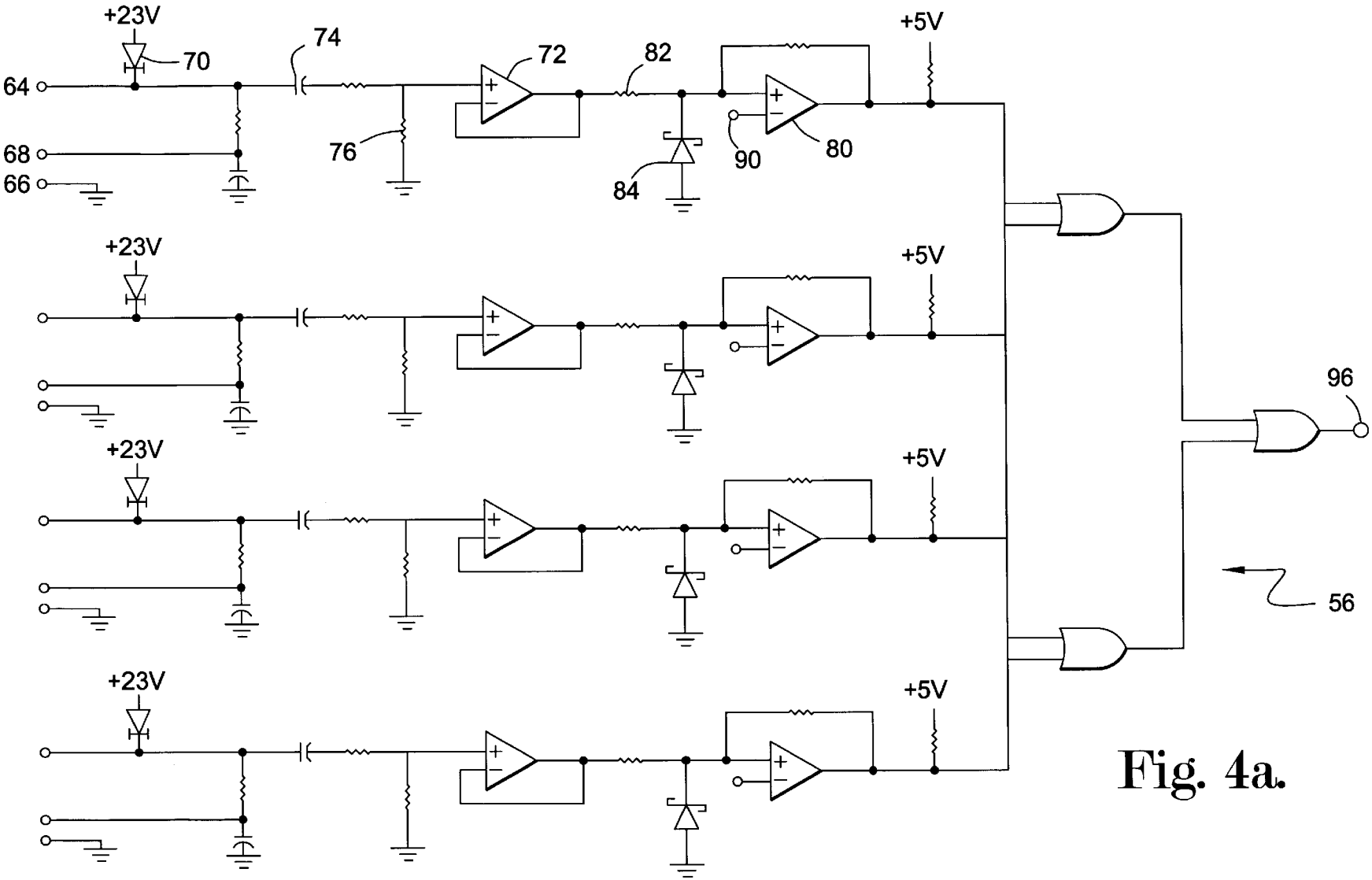
FIGS. 4*a* and 4*b* are schematic diagrams of the input circuitry for the detection circuit of FIG. 3.
Figure 4B:
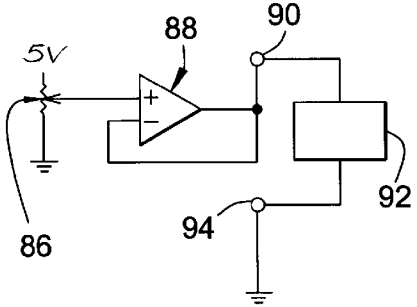

FIGS. 4*a*–4*b* illustrate the preferred input circuitry 56 for the present invention. As shown in FIG. 3, each of the four sensors 32*a*–32*d* is connected to the interface board 46. While the hot wires 52 from the sensors 32 are separately connected to the board 46, FIG. 3 shows only a single common wire 54 connected to the board 46. An alternative arrangement is contemplated in FIG. 4*a*, whereby the common wires from the sensors 32 are separately connected to the board 46. Only the input circuitry corresponding to sensor 32*a* will be discussed in detail because the input circuitry for each sensor 32 is identical.

In the preferred embodiment, the sensors 32 are connected to one or more connectors on the board 46. The sensor 32*a* is connected to a connector pin 64 and a connector pin 66. The hot wire from sensor 32*a* is connected to the circuitry 56 at pin 64, and the common wire from sensor 32*a* is connected to the circuitry 56 at pin 66. A node 68 is shown in both FIG. 4*a* and FIG. 5*a* and represents a connection between the input circuitry 56 and the alarm circuitry 58. With the sensor 32*a* connected as a load, the voltage at pin 64 with reference to ground is approximately 12 volts DC (direct current). The input circuitry 56 includes a diode 70 which controls the power provided to the sensor 32*a*. The diode 70 is preferably a 3 milliamp constant current diode. The input signal from the sensor 32*a* is AC coupled to an operational amplifier 72 through a capacitor 74. A resistor 76 provides a DC path to ground for the input signal on the capacitor 74. The signal is fed into a comparator 80 through a resistor 82Z. A diode 84 prevents the input signal to the comparator 80 from going negative with respect to ground.

With reference to FIG. 4*b*, the alarm threshold for the comparator 80 is set by adjusting a potentiometer 86 on the input of a voltage follower 88. The voltage follower 88 has an output 90 which is also the alarm threshold input 90 to the comparator 80 (FIG. 4*a*). As shown in FIG. 4*b*, leads from a voltmeter 92 can be connected to the output 90 and to a test jack 94 for measuring the voltage corresponding to the alarm threshold value. This voltage, which is typically between 0–5 volts, is proportional to the g-force value (e.g., one volt equals 1,000 g's). If the input from the sensor 32*a* exceeds the alarm threshold value, then the output of the comparator 80 will go high, thereby indicating an alarm at a node 96. The inputs from sensors 32*a*–32*d* are tied together in the input circuitry 56 so that any sensor 32 can create an alarm signal at node 96, which is shown in both FIG. 4*a* and FIG. 5*b* and represents a connection between the input circuitry 56 and the alarm circuitry 58.

Figure 5A:
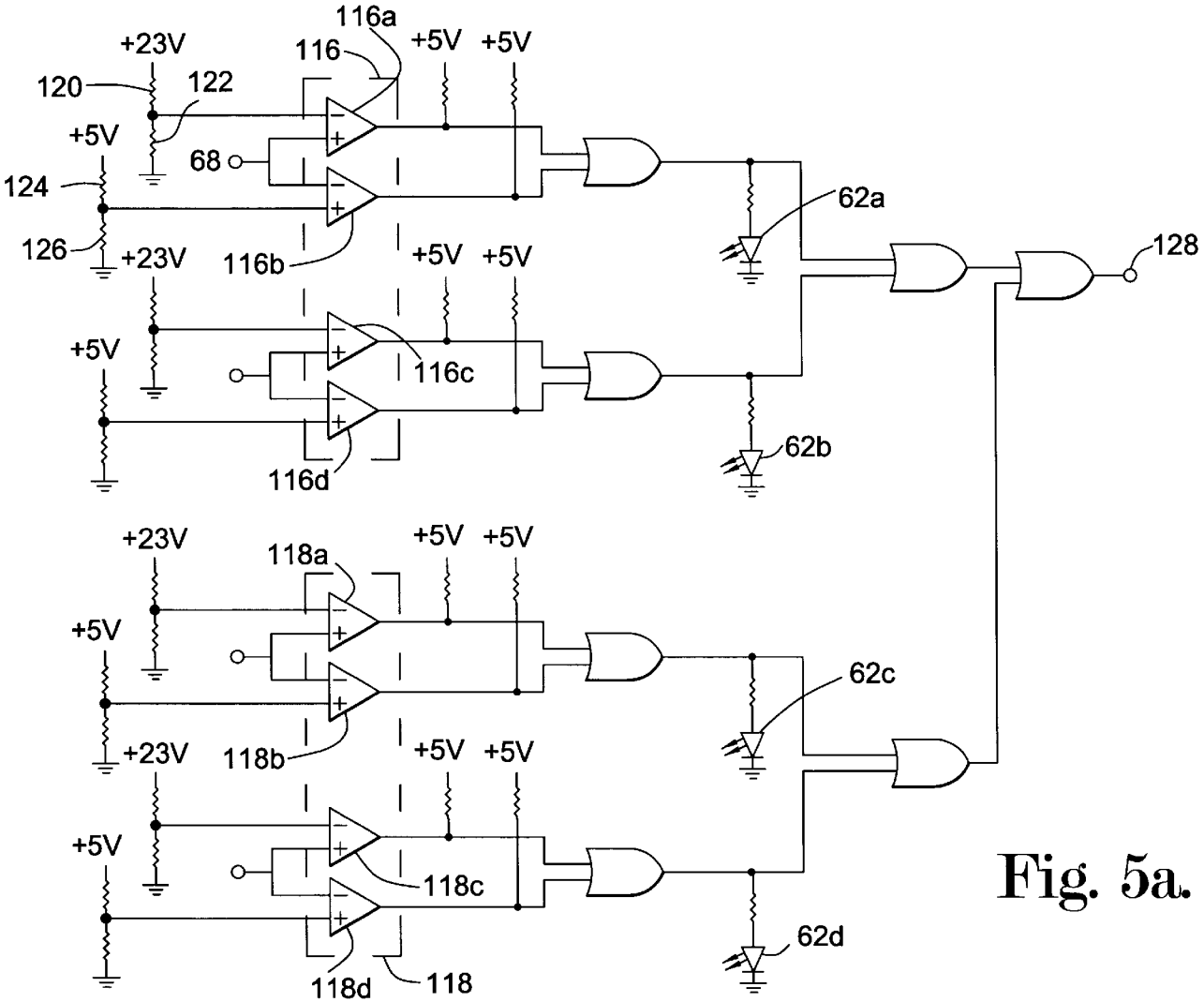
FIGS. 5*a* and 5*b* art schematic diagrams of the alarm circuitry for the detection circuit of FIG. 3.
Figure 5B:
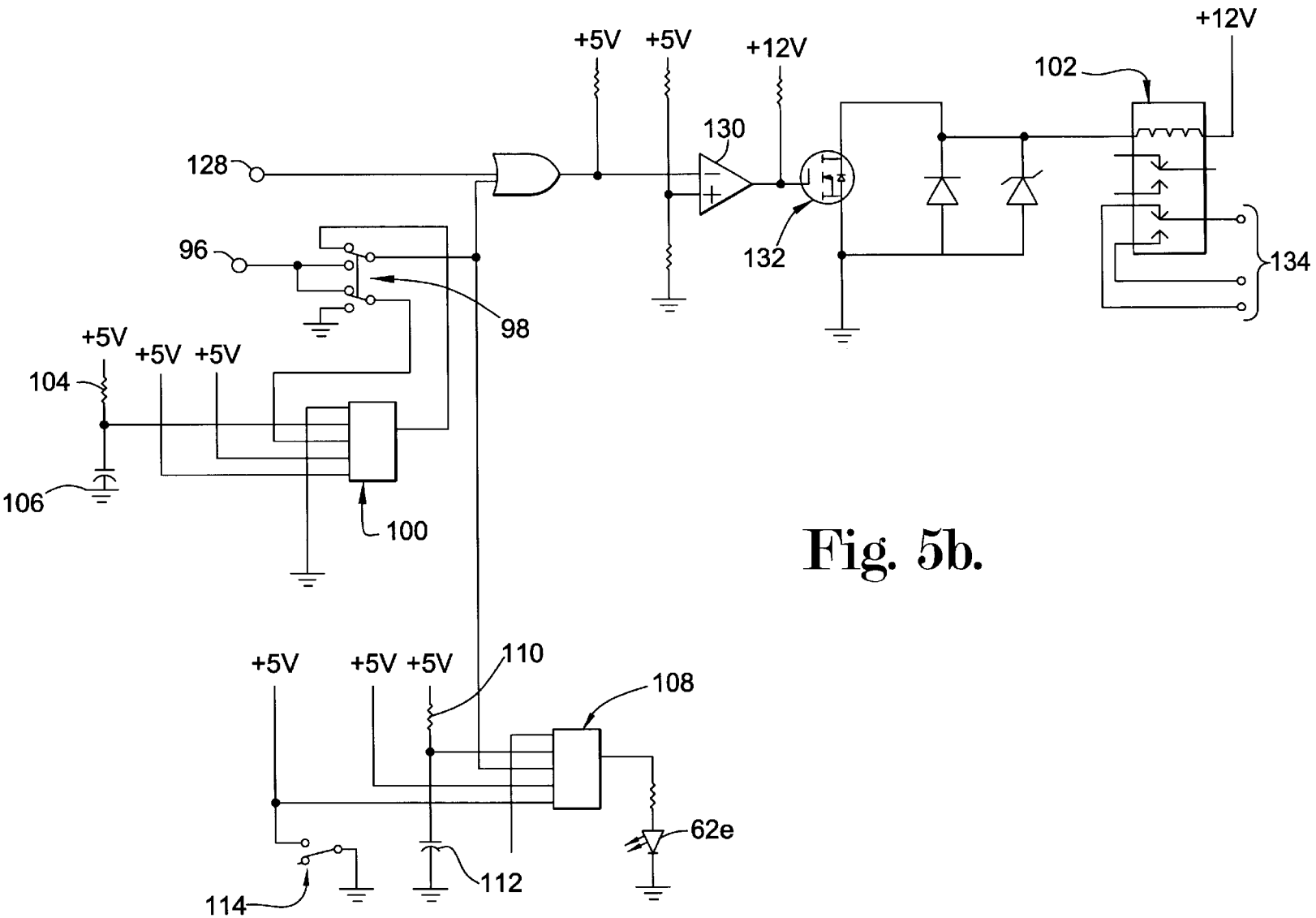

The preferred alarm circuitry 58 for the present invention is set forth in FIGS. 5*a* and 5*b*. Referring initially to FIG. 5*b*, the node 96 connects the input circuitry 56 to an optional toggle switch 98. When the switch 98 is in the "test" position, a precision monostable multivibrator 100 acts as a one-shot circuit to drive an alarm relay 102 for a relatively short period of time such as 0.1 seconds. The one-shot time delay is set by a resistor 104 and a capacitor 106 and is intended to reduce the likelihood that the relay 102 will miss any alarms. Another multivibrator 108 is used as a test indicator. When the impact element 12 is impacted by an object, multivibrator 108 will light the teat LED 62*e* for a relatively long period of time, such as two minutes and 20 seconds. This time delay is set by a resistor 110 and a capacitor 112 and should allow a person to walk from the dragger 10 to the equipment building to observe the test LED. Then, LED 62*e* can be cleared by pressing switch 114.

As shown in FIG. 5*a*, the alarm circuitry 58 also detects the presence of a fault (e.g., a short circuit or open circuit) in the sensor cables. The presence of a fault is indicated by the LEDs 62*a*–62*d*, which correspond to sensors 32*a*–32*d*, respectively. Thus, the present invention advantageously displays which of the sensors 32 has a faulty cable. Such faults are detected by a pair of comparators 116, 118, which look for a minimum and maximum sensor voltage. Only the alarm circuitry corresponding to sensor 32*a* will be discussed in detail because the alarm circuitry for each sensor 32 is identical. Node 68 (also shown in FIG. 4*a*) is connected to the comparators 116*a* and 116*b* and typically has a value of approximately 12 volts DC. The negative input to the comparator 116*a* represents the upper limit of the voltage for sensor 32*a*. This upper limit is a function of a resistor 120 and a resistor 122. Preferably, the ohm value of the resistor 120 is approximately one-tenth of the ohm value of the resistor 122, which yields an upper limit voltage of about 90 percent of the value of the DC voltage source (e.g., 90 percent of 23 volts). The positive input to the comparator 116*b* represents the lower limit of the voltage for sensor 32*a*. This lower limit is a function of a resistor 124 and a resistor 126. Preferably, the resistors 124, 126 have approximately the same ohm value so that the lower limit voltage is approximately 50 percent of the DC voltage source (e.g., 50 percent of 5 volts,). Thus, a fault would be detected if the voltage at node 68 either exceeds 21 volts or falls below 2.5 volts. The outputs of the window comparators 116, 118 are tied together so that a fault on any of the four sensor cables 38*a*–38*d* will result in an alarm condition at a node 128, which represents a connection between FIG. 5*a* and FIG. 5*b*.

Referring again to FIG. 5*b*, a comparator 130 has an output which is high when the sensor cables are intact and no alarms are occurring. This output drives a field-effect transistor (FET) 132 high and keeps the relay 102 energized. Thus, a power failure, a short or open in a sensor cable, or an alarm will de-energize the relay 102. The relay 102 provides an output 134 from the interface board 46 to the monitoring device 60. The relay is preferably a Form C relay, which can be configured as either "normally open" or "normally closed." The monitoring device 60 is preferably connected to a connector on the board 46, and the output 134 represents three connector pins.

The detection circuit 30 is powered by a conventional power source with an operating voltage between 9–16 volts DC, such as a 12 volt battery. The various circuit components are powered in a conventional manner. For example, operational amplifier 72 may be powered directly from the battery or through a conventional inverter circuit. Preferably, the circuitry of the present invention utilizes a conventional voltage doubler (which yields approximately 23 volts) and a conventional voltage regulator (which yields approximately 5 volts). The upper limit voltage input (FIG. 5*a*) and the comparators 116, 118 are driven by the voltage doubler, and the logic gates and lower limit voltage input are driven by the voltage regulator.

In operation, the dragger 10 of the present invention is positioned along the track 14 so that an object to be detected will impact the panel 12 as the train travels past the dragger 10 as shown in FIG. 2. Preferably, the edge of each panel 12 is located at least an inch from the foot of the rail to keep from shorting the track signals. Typically, the panels 12 are installed so that the top of the panel is at or below the top rail, and preferably one inch below the top rail. This enables the dragger 10 to detect those objects which generally present the highest risk of derailment without unnecessary stopping a fast-moving train. In a railroad yard, however, the trains move more slowly, and the dragger may extend one inch or more above the top rail so that air hoses and other dragging objects will be detected. The dragger 10 may be raised or lowered by adjusting the position of a jamnut on a jackscrew located at either end of the frame 18. Once the position is set, the dragger 10 is secured by tightening down the jamnut. Then, the sensor wires are connected to the interface board as shown in FIG. 3.

With the dragger 10 in position, the detection circuit 30 senses the force of an impact between an object dragging beneath a moving train and the impact panel 12. That is, the accelerometer 32 senses the g-foice of the impact, and the detection circuit 30 determines whether that g-force is greater than the alarm threshold set by the potentiometer 86.

Moreover, the window comparators 116, 118 of detection circuit 30 monitor the connection between the sensors 32 and the interface board 46 to detect faults. If the magnitude of any impact is greater than the predetermined magnitude of the alarm threshold, or if a fault is detected, then the detection circuit 30 will generate an output signal indicating an alarm condition.

As will be readily understood by those skilled in the art, the alarm threshold must be set low enough to detect objects which are likely to derail the train yet high enough to disregard objects such as icicles which are not likely to derail the train. To some extent, the alarm threshold setting is a function of the construction of the metal impact element 12. For example, the thickness of an air hose detector installed in a railroad yard might be half of the thickness of a dragger used for fast moving trains. The alarm threshold setting may also depend upon the shape of the impact element 12. In the embodiment of FIGS. 1 and 2, the alarm threshold may be set within the range of 300 to 4,500 g's, and typically at 2,000 g's for operation. However, the alarm threshold for an air hose detector may be set between 500 and 1,000 g's, and another construction of the impact element 12 (e.g., a vertical impact element) may dictate a different alarm threshold. Advantageously, the alarm threshold is uniform for all four sensors 32*a*–32*d* because the detection circuit 30 utilizes a single potentiometer 86 for all of the sensors.

The preferred embodiment of the present invention utilizes impact elements 12 which are reversible and, to some extent, interchangeable. As shown in FIGS. 1 and 2, the four impact elements are essentially identical to one another, except for their lengths. This construction facilitates detection of impacts from either direction and increases ease of maintenance and repair. The outside elements 12*a*, 12*b* are interchangeable with one another, and the inside elements 12*c*, 12*d* are interchangeable with one another. Each of the reversible elements 12 preferably includes two sidewalls or ramps which converge upwardly at an angle of approximately 45 degrees, and the plates 50 are angled to be flush with the sidewalls when the sensors 32 are in position. However, the impact elements 12 may be (constructed such that the sidewalls (and plates) converge at some other angle (e.g., 30 degrees). In fact, the construction of element 12 may differ substantially from that shown in FIGS. 1 and 2, provided the sensor 32 can still detect impacts from either direction. Otherwise, the impact elements would not be reversible.

FIGS. 3, 4*a*–4*b* and 5*a*–5*b* are exemplary of many different circuits contemplated for accomplishing the objects and advantages of the present invention. Those skilled in the art will readily appreciate any number of modifications, substitutions and enhancements that could be made to the disclosed circuitry.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. An apparatus for detecting objects dragging beneath a train as the train travels along a track, the apparatus comprising:

a stationary impact element for being rigidly supported along the track in a position intersecting a path of movement of the objects being dragged beneath the train so that the objects impact said impact element; and a detection circuit including a sensor coupled with said impact element for sensing the force of impacts between the objects and said impact element.

2. The apparatus of claim 1 wherein the impact element is reversible.

3. The apparatus of claim 1 further comprising a second stationary impact element.

4. The apparatus of claim 3 wherein the detection circuit includes a second sensor coupled with the second impact element for sensing the force of the impacts between the objects and the second impact element.

5. The apparatus of claim 4 further comprising a third stationary impact element and a fourth stationary impact element, and wherein the detection circuit includes a third sensor coupled with the third impact element and a fourth sensor coupled with the fourth impact element for sensing the force of the impacts between the objects and the third and fourth impact elements.

6. The apparatus of claim 5 further comprising a frame adapted for mounting the first and second impact elements inside the track and for mounting the third and fourth impact elements outside the track.

7. The apparatus of claim 6 wherein the first and second impact elements are rigidly coupled together.

8. The apparatus of claim 1 wherein the sensor is an accelerometer.

9. The apparatus of claim 1 wherein the detection circuit includes a fault detector.

10. The apparatus of claim 9 wherein the fault detector detects a power failure.

11. The apparatus of claim 9 wherein the fault detector detects an open circuit.

12. The apparatus of claim 9 wherein the fault detector detects a short circuit.

13. The apparatus of claim 9 wherein the detection circuit includes a relay for providing an output to a monitoring device indicating the presence of a detected fault.

14. The apparatus of claim 1 wherein the detection circuit includes a relay for providing an output to a monitoring device indicating the occurrence of an impact having a magnitude greater than a predetermined magnitude.

15. The apparatus of claim 1 wherein the detection circuit includes at least one indicator for indicating the presence of an alarm condition.

16. A method of detecting objects dragging beneath a train as the train travels along a track, the method comprising the steps of:

positioning a stationary impact element along the track in a fixed position intersecting a path of movement of the objects being dragged beneath the train so that the objects impact the stationary element;

sensing impact force of each object; and generating an output signal if a magnitude of the impact force is greater than a predetermined magnitude.

17. The method of claim 16 further comprising the step of indicating the occurrence of an impact in response to generating the output signal.

18. The method of claim 17 wherein said indicating step further comprises actuating an alarm.

19. The method of claim 16 further comprising the step of detecting faults in a circuit coupled with the stationary impact element.

20. The method of claim 19 further comprising the step of generating an output signal upon detecting a fault in the circuit.

21. Apparatus for detecting objects suspended from and dragged beneath a train as the train travels along rails of a railroad track, the apparatus comprising:

an impact element that is mounted adjacent a railroad track and extending generally in a direction across the track, with the impact element presenting at least one surface that is impacted by an object suspended down from said train to the impact surface when the train and the object pass the impact element, with the impact of the object on the impact surface inducing a G-force within the impact element;

at least one accelerometer coupled to the impact element for generating a signal indicative of a magnitude of the (G-force induced in the impact element as a result of the impact by the object; and a detection circuit receiving the signal from the accelerometer and generating an impact signal.

22. The apparatus of claim 21 wherein the rails of the railroad track have a top side and wherein the accelerometer is a single axis sensor and is positioned in a plane generally parallel to the top side of the rails of the railroad track so as to sense primarily the component of the G-force induced in the impact element in the direction of the track upon impact.

23. The apparatus of claim 21 wherein the impact surface has a top and a bottom and is inclined from said bottom to said top in a direction that the train travels to facilitate movement of the object over the impact element.

24. The apparatus of claim 21 wherein the impact element comprises two impact surfaces both having upper ends, one at each side of the impact element, inclined in opposed directions, and joined at said upper ends.

25. The apparatus of claim 22 wherein the accelerometer is housed beneath the impact surfaces.

26. The apparatus of claim 21 wherein the detection circuit generates said impact signal only when the G-force exceeds a predetermined level.

27. A method for detecting objects suspended from and dragging beneath a train as the train travels along rails of a railroad track, the method comprising the steps of:

positioning an impact element adjacent a railroad track so that said impact element extends generally in a direction across the track with the impact element presenting at least one surface that is impacted by an object suspended down from said train to a level below the top of the impact surface when the train and the object pass the impact element, with the impact of the object on the impact surface inducing a G-force within the impact element;

coupling at least one accelerometer to said impact element wherein said accelerometer generates a signal indicative of the magnitude of the G-force induced in the impact element as a result of the impact by the object; and coupling a detection circuit with said accelerometer for receiving the signal from the accelerometer and generating an impact signal.

28. The method of claim 27, further comprising:

sensing each impact's G-force; and generating an output signal if said G-force is greater than a predetermined magnitude.

29. The method of claim 28 wherein the component of each impact's G-force that is primarily sensed is the G-force induced in the impact element in the direction of the track upon impact.

30. The method of claim 28, further comprising:

indicating the occurrence of an impact in response to generating the output signal.

31. The method of claim 28, further comprising:

detecting faults in said circuit coupled with said impact element.

* * * * *